US011136183B2

(12) United States Patent
Ota

(10) Patent No.: US 11,136,183 B2
(45) Date of Patent: Oct. 5, 2021

(54) CONTAINER

(71) Applicant: Hideyuki Ota, Tokyo (JP)

(72) Inventor: Hideyuki Ota, Tokyo (JP)

( * ) Notice: Subject to any disclaimer, the term of this patent is extended or adjusted under 35 U.S.C. 154(b) by 0 days.

(21) Appl. No.: 16/307,774

(22) PCT Filed: Jun. 6, 2017

(86) PCT No.: PCT/JP2017/021029

§ 371 (c)(1),
(2) Date: Dec. 6, 2018

(87) PCT Pub. No.: WO2017/213154

PCT Pub. Date: Dec. 14, 2017

(65) Prior Publication Data

US 2019/0263587 A1 Aug. 29, 2019

(30) Foreign Application Priority Data

Jun. 7, 2016 (JP) ..... JP2016-113863
Mar. 9, 2017 (JP) ..... JP2017-045497

(51) Int. Cl.
*B65D 88/52* (2006.01)
*B65D 88/12* (2006.01)
(Continued)

(52) U.S. Cl.
CPC ..... *B65D 88/005* (2013.01); *B65D 21/066* (2013.01); *B65D 21/086* (2013.01); *B65D 88/12* (2013.01); *B65D 88/52* (2013.01)

(58) Field of Classification Search
CPC ..... B65D 88/52; B65D 88/12; B65D 88/005; B65D 88/022; B65D 88/121;
(Continued)

(56) References Cited

U.S. PATENT DOCUMENTS 2,868,407 A * 1/1959 Woodcock ..... B65D 88/524 220/7
4,684,034 A * 8/1987 Ono ..... B65D 7/24 220/1.5
(Continued)

FOREIGN PATENT DOCUMENTS

GB 2160851 1/1986
JP 63-018611 5/1988
(Continued)

OTHER PUBLICATIONS

Official Communication issued in International Patent Application No. PCT/JP2017/021029, dated Aug. 1, 2017, along with English language translation.
(Continued)

*Primary Examiner* — Andrew D Perreault
(74) *Attorney, Agent, or Firm* — Greenblum & Bernstein, P.L.C.

(57) ABSTRACT

A container includes: an upper container part constituting an upper half of a container body having a horizontally elongate rectangular parallelepiped shape; a lower container part constituting a lower half of the container body; four posts disposed at the four corners of the container body; and hinges 20 rotatably retaining the posts at the four corners of at least one of the upper container part or the lower container part. The container body can be transformed between a first state in which the upper container part is retained at a first height with respect to the lower container part and a second state in which the container body is retained at a second height that is lower than the first height. In the second state, the posts are rotated inward in the lengthwise direction of the container body by the hinges.

16 Claims, 14 Drawing Sheets

(51) Int. Cl.

| | |
|---|---|
| ***B65D 90/02*** | (2019.01) |
| ***B65D 88/00*** | (2006.01) |
| ***B65D 21/08*** | (2006.01) |
| ***B65D 21/06*** | (2006.01) |

(58) Field of Classification Search

CPC .... B65D 88/524; B65D 88/522; B65D 90/02; B65D 21/06; B65D 21/066; B65D 7/24; B65D 7/30; B65D 21/086

USPC ..... 220/1.5, 6, 7, 8

See application file for complete search history.

(56) References Cited

U.S. PATENT DOCUMENTS

| | | | | |
|---|---|---|---|---|
| 5,509,559 | A | 4/1996 | Okano et al. | |
| 6,112,929 | A | 9/2000 | Ota | |
| 9,718,611 | B2 * | 8/2017 | Rio Gonzalez .... | B65D 90/0006 |
| 2004/0232146 | A1 * | 11/2004 | Kessler ..... | B65D 7/26 220/6 |
| 2012/0248105 | A1 * | 10/2012 | Leong ..... | B65D 88/524 220/7 |
| 2014/0246425 | A1 | 9/2014 | Janin | |
| 2015/0266666 | A1 | 9/2015 | Wong | |

FOREIGN PATENT DOCUMENTS

| | | |
|---|---|---|
| JP | 03-035186 | 5/1991 |
| JP | 06-321286 | 11/1994 |
| JP | 8-26268 A | 1/1996 |
| JP | H09-188188 | 7/1997 |
| JP | 2002-534327 | 10/2002 |
| JP | 2007-137469 | 6/2007 |
| WO | 00/40481 | 7/2000 |

OTHER PUBLICATIONS

Office Action issued in European Patent Office (EPO) Counterpart Patent Appl. No. 17810328.9, dated Feb. 13, 2020.

Korean Office Action, Korean Patent Office, Application No. 10-2018-7035304, dated Aug. 5, 2020.

* cited by examiner (a)

(b)

(a)

(b)

(a)

(b)

(a)

(b)

CONTAINER

TECHNICAL FIELD

The present invention relates to a container used in cargo transportation.

BACKGROUND ART

Because the demands for cargo transportation are generally asymmetric between regions, cargo transportation using containers often results in containers being empty on the outbound or return route. Since containers occupy the same volume regardless of whether or not they are loaded with cargo, transporting large numbers of empty containers results in a great waste of space, and thus transport efficiency is significantly reduced. In response to such problems, the present inventor proposed (Patent Document 1) a cargo container with which it is possible to fold the upper halves of the posts at the four corners of a dry container along the lower halves, so that the dry container can be collapsed in the vertical direction, allowing the volume to be reduced by approximately 50%.

PRIOR ART DOCUMENT

Patent Document

Patent Document 1:
Japanese Unexamined Patent Publication No. 2002-534327

SUMMARY OF THE INVENTION

Problem to be Solved by the Invention

However, even with a configuration that can reduce the volume by approximately 50% as in Patent Document 1, if it takes time to transform the container, work will be less efficient and thus transportation costs will be impacted. Furthermore, if the mechanism is made more complex in order to improve work efficiency, the cost of the container itself will increase.

An object of the present invention is to provide a container having a simple configuration, the volume of which can easily be changed.

Means for Solving the Problems

The container of the present invention comprises: an upper container part constituting an upper half of a container body having a horizontally elongate rectangular parallelepiped shape; a lower container part constituting a lower half of the container body; four posts disposed at the four corners of the container body; and rotational retaining means for rotatably retaining the posts at the four corners of at least one of the upper container part or the lower container part, wherein the container body can be transformed between a first state in which the upper container part is retained at a first height with respect to the lower container part and a second state in which the container body is retained at a second height that is lower than the first height, and in the second state, the posts are rotated inward in the lengthwise direction of the container body by the rotational retaining means.

The container is such that the upper container part or the lower container part comprises four auxiliary posts for supporting the upper container part on the lower container part, in the second state. The container further comprises an auxiliary post locking mechanism for fastening the auxiliary post to the upper container part or the lower container part, in order to maintain the second state. The container further comprises a post locking mechanism that locks the movement of the posts, in order to maintain the first state. The posts that form a pair in the width direction of the container body are integrally configured. A post tilting assist mechanism that assists the movement of the posts from the first state to the second state is further comprised.

The rotational retaining means rotatably retains the posts at the four corners of the upper container part and the lower container part, and each of the posts comprises a bending part which can bend inward. The container further comprises a linking means that links the bending parts of the posts that form a pair in the lengthwise direction of the container body. The faces that form a pair in the lengthwise direction of the container body comprise a door or a wall, and the door or the wall is retained by the posts. The side faces that form a pair in the width direction of the container body are deformable.

The rotational retaining means retains either one of the top end or the bottom end of each of the posts at the four corners of the upper container part, and the other end of the posts can be moved along the two lengthwise side edges of the lower container part. The container further comprises a counterbalancing mechanism for counterbalancing the weight of the upper container part.

Effect of the Invention

According to the present invention, a container is provided having a simple configuration, the volume of which can easily be changed.

EMBODIMENT OF THE INVENTION

Hereafter, embodiments of the present invention are described with reference to the accompanying drawings.

Figure 1:
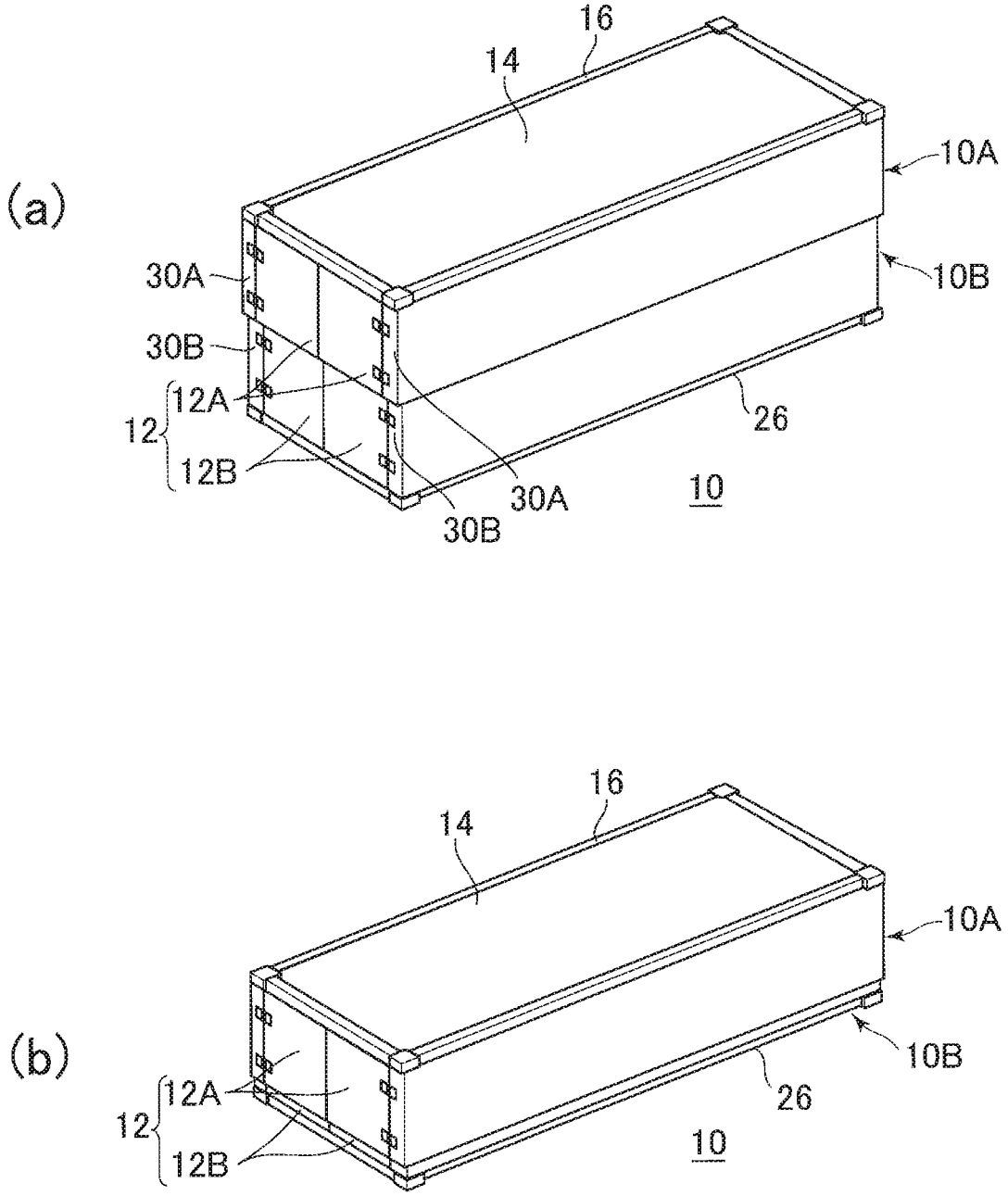
FIG. 1 is a perspective view of a first embodiment of the present invention.

FIG. 1 is a perspective view of a transformable container according to a first embodiment of the present invention, before and after transformation.

A container 10 in a first embodiment is a dry container of a substantially rectangular parallelepiped shape, used for cargo transport, for example. The container 10 may be, for example, a container conforming to the ISO standard, but it may also be a container manufactured according to other standards or according to original specifications. The container 10 is divided into upper and lower parts, at approximately one half of the height, and principally comprises an upper container part 10A, constituting the upper half, and a lower container part 10B, constituting the lower half. The upper container part 10A can be raised and lowered with respect to the lower container part 10B. In the first embodiment, when the upper container part 10A is lowered, the lower container part 10B is housed inside the interior of the upper container part 10A.

FIG. 1 (*a*) shows the first state in which the upper container part 10A has been raised to the maximum height (first height) such that the container volume has been maximized. FIG. 1 (*b*) shows the second state in which the upper container part 10A has been lowered to the minimum height (second height) such that the container volume has been minimized. In this embodiment, the height of the container 10 in the second state is approximately one half the height in the first state, and thus the container volume is approximately halved. Note that, ordinarily, cargo is loaded in the container 10 in the first state, and when empty, the container 10 is placed in the second state.

A double door 12 is, for example, provided in one end of the container 10 in the lengthwise direction, and a rear wall 13 (13A, 13B) is provided at the other end. The door 12 and the rear wall 13 are divided into upper doors 12A and an upper rear wall 13A which are mounted on the upper container part 10A (see FIG. 2) and lower doors 12B and a lower rear wall 13B, which are mounted on the lower container part 10B. As for the container 10 of the first embodiment, each of the upper doors 12A are mounted at the edges (outer walls) 30A of the two sides of an opening in the upper container part 10A, by way of hinges or the like. Likewise, each of the lower doors 12B are mounted at the edges (outer walls) 30B of the two sides of the opening in the lower container part 10B, by way of hinges or the like. Note that the upper rear wall 13A and the lower rear wall 13B (see FIG. 2) may be integrally configured with the side walls.

Figure 2:
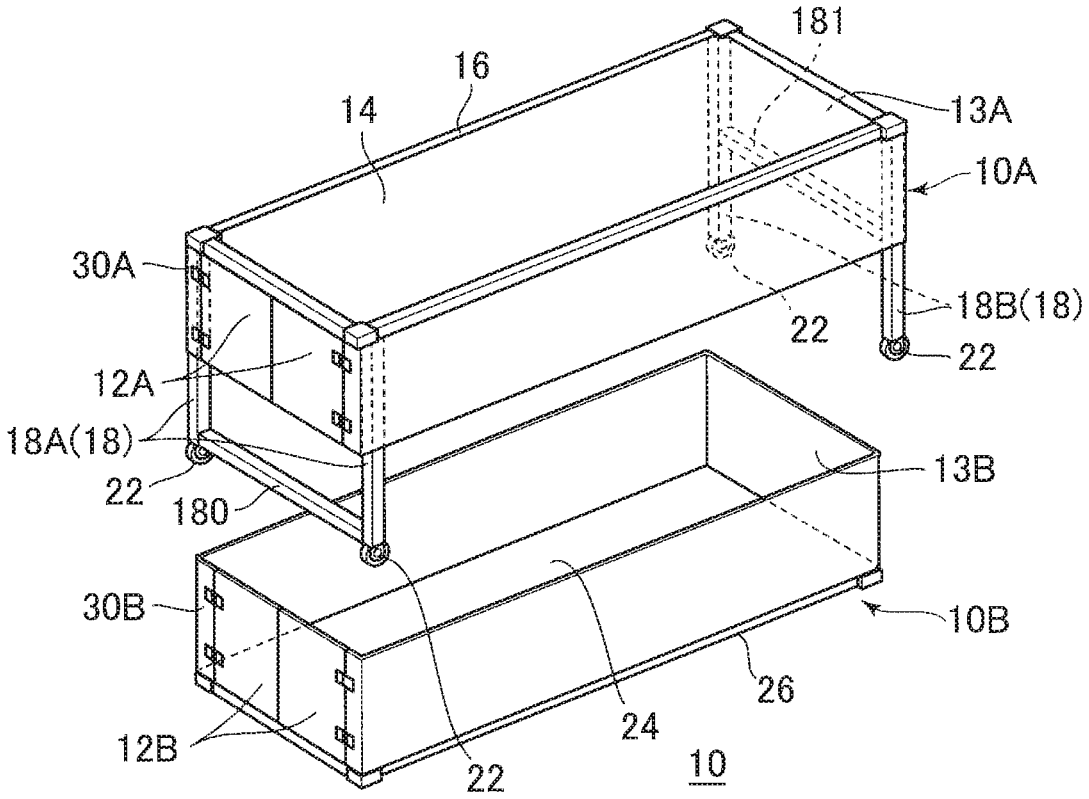
FIG. 2 is an exploded perspective view of the container in FIG. 1.

FIG. 2 is an exploded perspective view in which the container 10 has been divided into the upper container part 10A and the lower container part 10B. As shown in the drawing, the upper container part 10A comprises an upper frame 16 formed in a rectangular shape, which supports the four edges of a roof panel 14, and each of the four corners of the upper frame 16 are respectively supported by four posts 18. The top ends of the posts 18 are attached to the four corners of the upper frame 16 via rotational mechanisms of hinges 20 (see FIG. 5), and each of the posts 18 is pivotable about a hinge 20, toward the inside of the container body in the lengthwise direction. Furthermore, a roller 22 is provided at the bottom end of each of the posts for moving the bottom ends of the posts 18 along the lengthwise direction of the container body.

On the other hand, the lower container part 10B comprises a lower frame 26 configured in a rectangular shape, which supports the four edges of a floor panel 24. The external dimensions of the lower frame 26 are substantially the same as those of the upper frame 16, such that the bottom ends of the four posts 18, when standing vertically, are supported by the bottom panel 24 at positions above the four corners of the lower frame 26.

The bottom ends and/or the top ends of one pair of posts 18A, 18A from among the four posts 18, which are arranged near the doors 12, are connected to each other, for example by rod members, such that the two posts 18A, 18A are integrally configured. In the example in FIG. 2, the bottom ends are connected to each other by rod members 180. Furthermore, the pair of posts 18B, 18B, which are arranged at the end of the container 10 opposite the doors 12, are also connected to each other by rod members at the bottom ends, at the top ends, at midway points, or in multiple places combining these places, and thus integrally configured. In the example in FIG. 2, midway points are connected to each other by rod members 181. That is to say, when the posts 18 rotate around the hinges 20 (FIG. 5), the pair of posts 18A, 18A and the pair of posts 18B, 18B each integrally rotate respectively.

Figure 3:
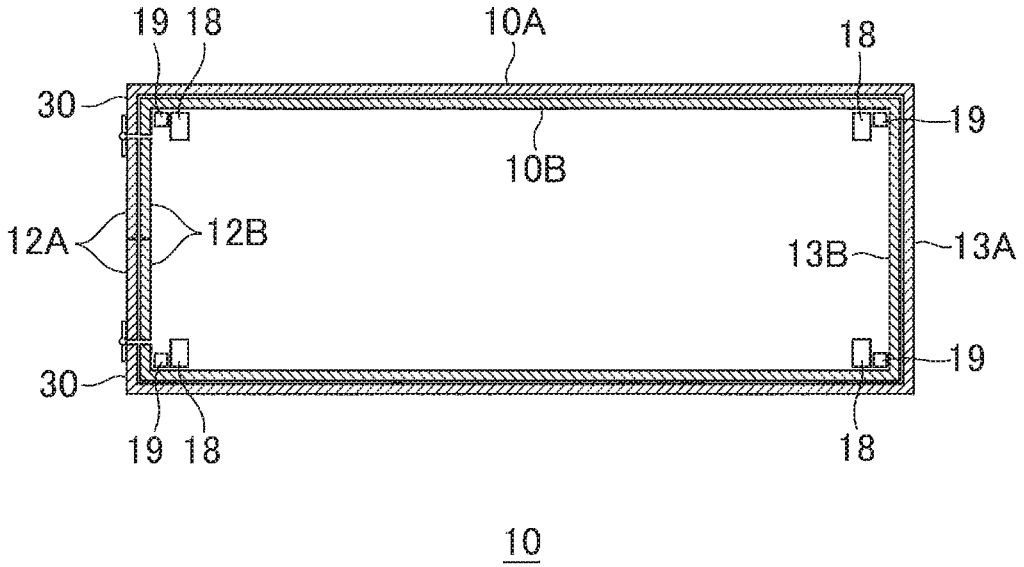
FIG. 3 is a horizontal sectional view of the container in FIG. 1.

FIG. 3 is a horizontal sectional view of the container 10 in the second state. As shown in FIG. 3, in the first embodiment, the outer shell of the lower container part 10B is slightly smaller than the upper container part 10A, as seen in a plan view, such that in the second state, the side walls and the lower doors 12B of the lower container part 10B are received in a nested manner inside of the side walls and upper doors 12A of the upper container part 10A. Furthermore, four auxiliary posts 19 are provided at the four corners of the upper container part 10A, in order to support the upper container part 10A with the lower container part 10B, in the second state. The auxiliary posts 19 are, for example, mounted integrally with the frame 16 of the upper container part 10A, oriented vertically downward therefrom. The arrangement of the posts 18 in the first state is shown in FIG. 3 and, as illustrated, the auxiliary posts 19 are arranged on the lengthwise outsides of the posts 18.

Figure 4:
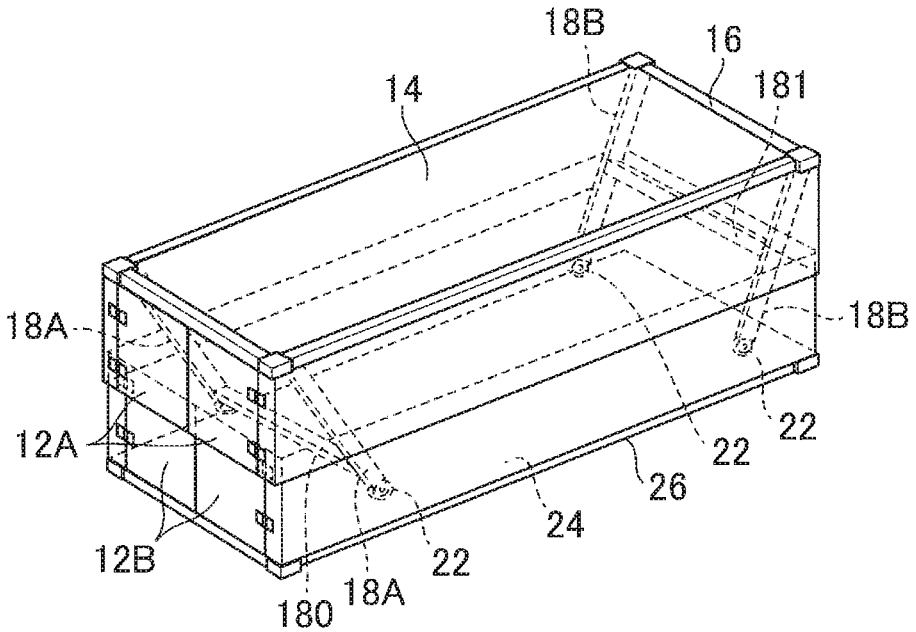
FIG. 4 is a perspective view of the container in FIG. 1, midway in the transformation from the first state to the second state.
Figure 5:
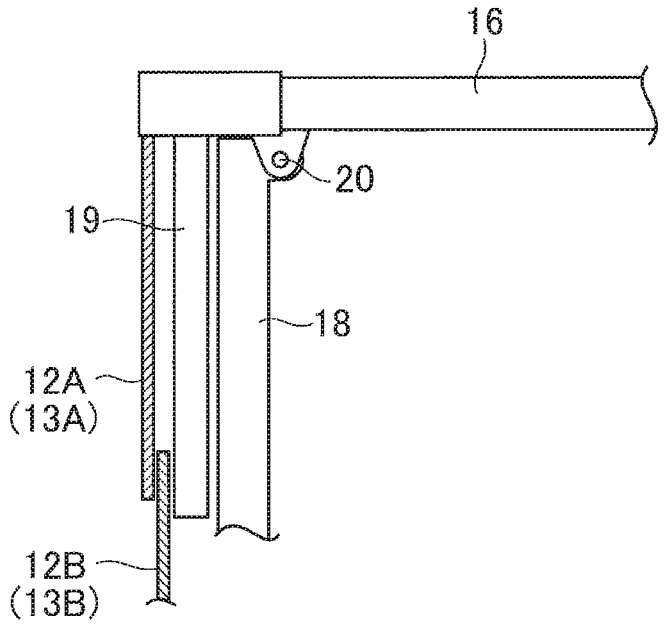
FIG. 5 is an expanded side view of the vicinity of a post hinge.
Figure 5:
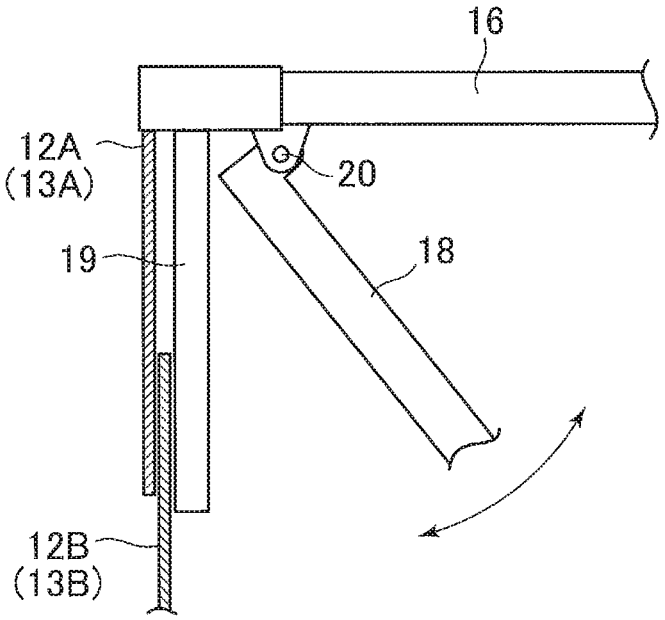

FIG. 4 is a perspective view showing a state midway in the transition of the container 10 from the first state (FIG. 1 (*a*)) to the second state (FIG. 1 (*b*)). By sliding the bottom ends of the posts 18A, 18A and the bottom ends of the posts 18B, 18B in the lengthwise direction of the container 10, as shown in FIG. 4, the upper container part 10A is lowered toward the lower container part 10B, and the lower container part 10B is housed inside the upper container part 10A. In the first state, the top end faces of the posts 18 support the frame 16 by abutting against the bottom faces of the four corners of the frame 16, as shown in FIG. 5 (*a*). On the other hand, when the posts 18A, 18A and posts 18B, 18B are each pushed inward, and the bottom ends move over the floor panel 24, along the two sidewalls, the posts 18 rotate around the hinges 20, as shown in FIG. 5 (*b*) and, in conjunction therewith, the upper container part 10A is lowered as shown in FIG. 4, such that the lower container part 10B is housed inside the upper container part 10A.

Figure 6:
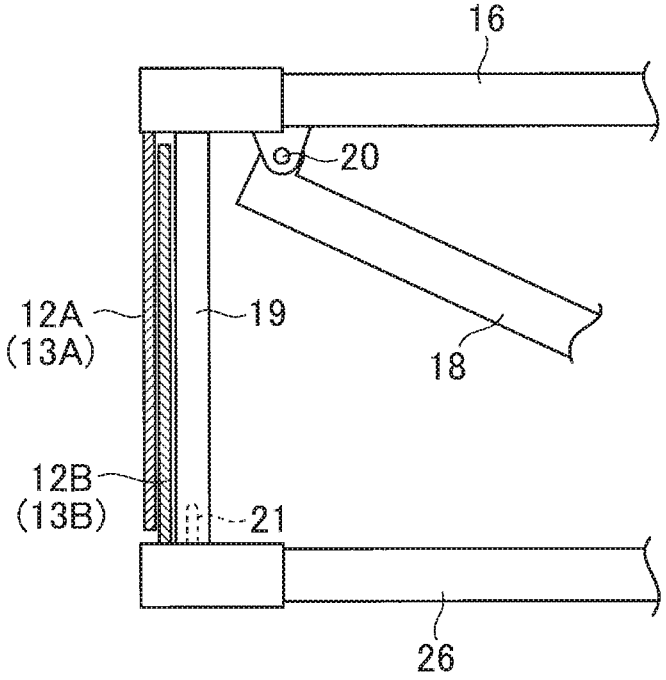
FIG. 6 is an enlarged side view in the vicinity of the post hinge in the second state.

The auxiliary posts 19, which extend vertically downward from the four corners of the frame 16 are also lowered together with the upper container part 10A, and when the second state height is reached, the bottom ends of the auxiliary posts 19 abut the four corners of the frame 26 of the lower container part 10B, or the top of the floor panel 24 above the corners, as shown in FIG. 6. Consequently, the four corners of the upper container part 10A are supported by the auxiliary posts 19. Furthermore, the bottom ends of the auxiliary posts 19 engage with the four corners of the frame 26 of the lower container part 10B, and auxiliary post locking members 21, which fasten the auxiliary post 19 to the frame 26, are provided on each of the four corners. The auxiliary post locking members 21 extend, for example, vertically from the frame 26, and fit into the bottom ends of the auxiliary posts 19. The auxiliary posts 19 and the auxiliary post locking members 21 are fixed by a fastener (not illustrated) such as a bolt, for example. Thereby, in the second state, even if the upper container part 10A is lifted up, the upper container part 10A will not separate from the lower container part 10B, and thus they can be handled integrally.

Figure 7:
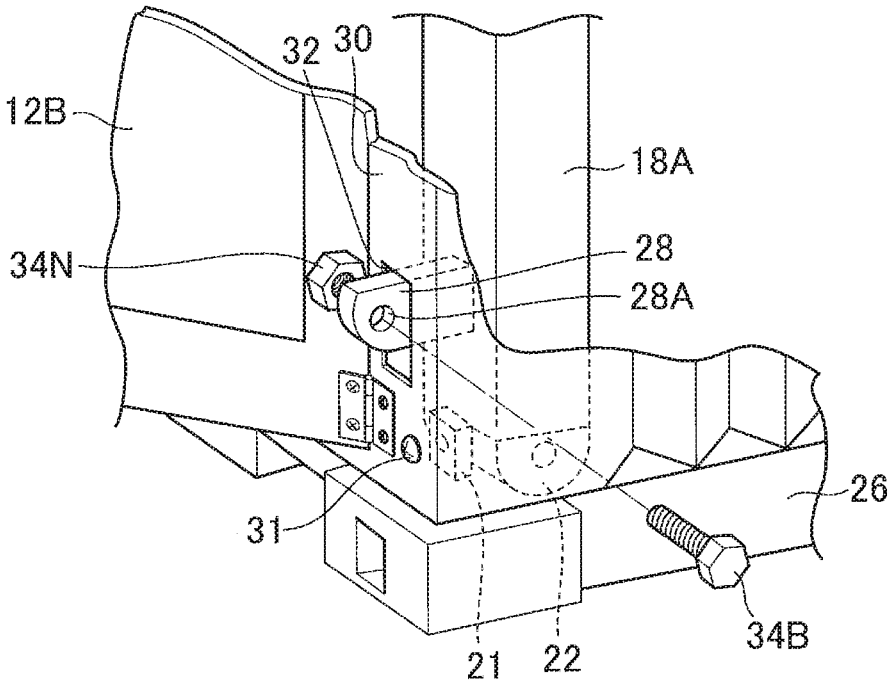
FIG. 7 is a view showing the structure of a locking mechanism provided in the vicinity of the bottom end of a post.

When the container 10 is to be loaded, it is necessary for the posts 18 to be raised, and for the posts 18 to be fastened in the first state. Thereby, a post locking mechanism is provided on the posts 18, for fastening the posts 18 in the upright position. In the present embodiment, for example as shown in the enlarged partial cutaway view in FIG. 7, a protruding piece 28 is provided, which projects outward in the lengthwise direction of the container 10, in the vicinity of the bottom end of the post 18. For example, when the posts 18A are upright, the posts 18A abut the edges 30B on both sides, to which the lower doors 12B are attached, and which are part of the outer walls of the lower container part 10B, and the protruding pieces 28 project outward, passing through openings 32, which are provided in the side edges 30B. A hole 28A is provided on the protruding piece 28, through which an engaging member such as a bolt 34B is passed. When the posts are fastened in place, the bolt 34B is inserted into the protruding piece 28, and a nut 34N is screwed on. Protruding pieces 28 are likewise provided on the posts 18B, and openings are provided in the walls on the opposite end from the doors 12, into which the protruding pieces 28 on the posts 18B are inserted, whereby the upright posts 18B are fastened in their positions using bolts 34B and nuts 34N.

In order to transform the container 10, which is in the first state shown in FIG. 1 (*a*), into the second state shown in FIG. 1 (*b*), the fastening of the posts 18 with the post locking mechanism using a bolt 34B or the like is released, the posts 18A, 18A and the posts 18B, 18B are pushed inward in the lengthwise direction of the container 10, from the two ends of the container 10, and are rotated around the hinges 20, so as to be tilted, as shown in FIG. 4. Once the posts 18 have been tilted to a certain angle, the posts 18 will naturally tilt due to the weight of the upper container part 10A, such that the container 10 will collapse under its own weight, resulting in the second state shown in FIG. 1 (*b*). Here, it is preferable to mount a rotary damper on the hinge 20, in order to control the speed at which the posts 18 tilt.

Figure 8:
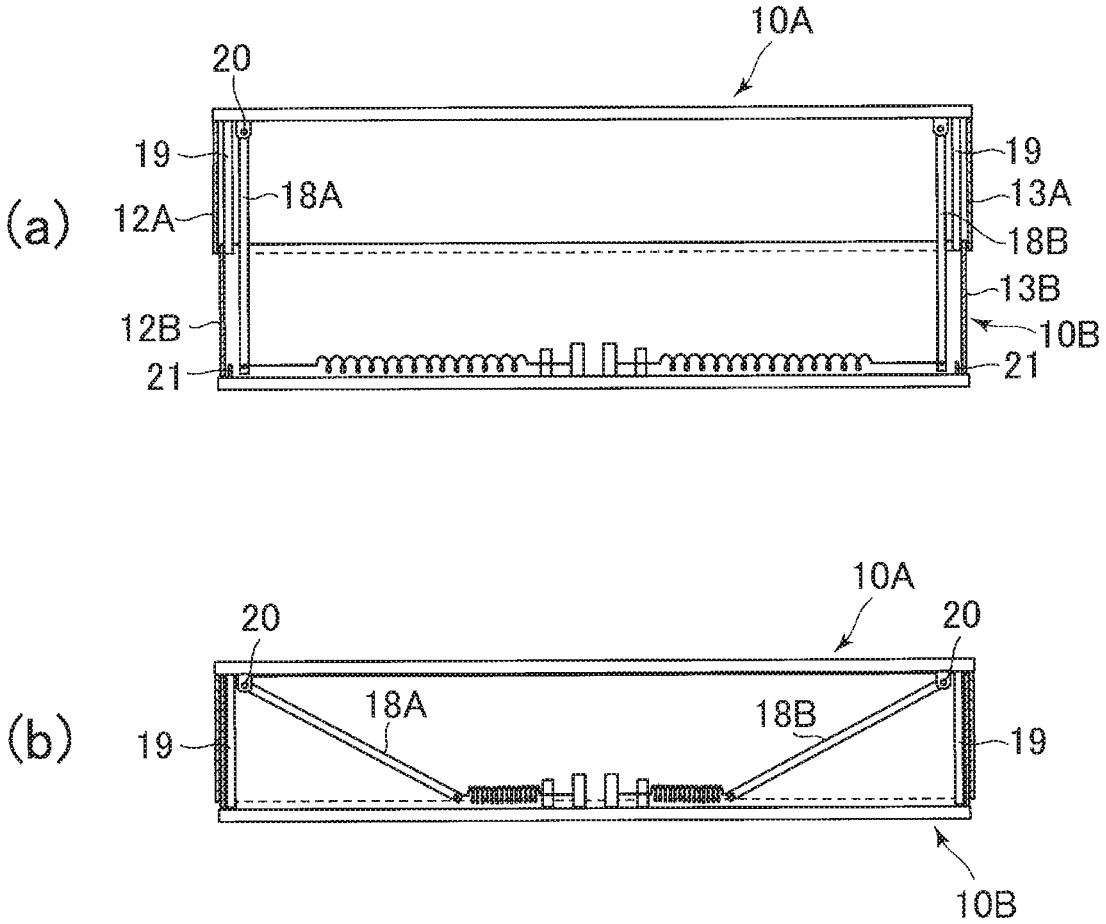
FIG. 8 is a view illustrating one example of a post tilting assist mechanism.

Further, a post tilting assist mechanism may also be provided in order to assist and promote the tilting of the posts 18. FIG. 8 shows one example of a post tilting assist mechanism using a biasing member such as a spring 36. FIG. 8 (*a*) shows the situation when the container 10 is in the first state with the four posts 18 upright, and FIG. 8 (*b*) shows the situation when the container 10 is in the second state with the posts 18 completely tilted and the lower container part 10B housed in the upper container part 10A. For example, when the retention of the posts 18 by the post locking mechanisms is released, the bottom ends of the posts 18 are slid inward by the post tilting assist mechanism.

With the configuration in FIG. 8, fastening members 38 are provided near the sidewalls, in the vicinity of floor panel 26 of the lower container part 10B, to which the ends of springs 36 are attached. The other ends of the springs 36 are attached to the bottom ends of the posts 18. Namely, the springs 36 are attached in an extended state, between the bottom ends of the posts 18 and the fastening members 38, so that the posts 18 are biased longitudinally inward along the bottom edge of the lower container part 10B. With this configuration, when the post locking mechanism is released, the operator can easily push down the posts 18A, 18B inward from both sides.

Furthermore, for example, a pulling instrument such as a wire or a chain, in place of the spring 36, can also be used as the post tilting assist mechanism. For example, pulling devices having a crank mechanism or the like are provided on both sides of the approximate center in the lengthwise direction of the container body, whereby the pulling instrument is wound up to tow the posts inward.

Figure 9:
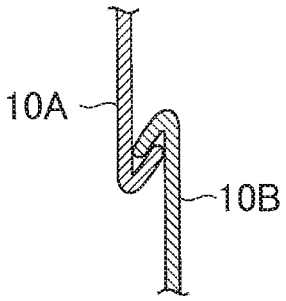
FIG. 9 is a view illustrating the state in which the bottom edges of the outer walls of the upper container part and the top edges of the outer walls of the lower container part are engaged.

In the first state in which cargo is loaded, it is necessary that the container 10 be sealable to a certain degree. However, because the outer walls and the door 12 of the container 10 are vertically divided into two parts, i.e., the upper container part 10A and the lower container part 10B, a structure that is sealable to a certain degree is required at the joint between the upper container part 10A and the lower container part 10B. Thus, the clearance between the outer walls of the upper container part 10A and the lower container part 10B and the clearance between the doors 12A and the doors 12B are made as small as possible. Furthermore, in the present embodiment, in the first state, the bottom edges of the outer walls of the upper container part 10A and the doors 12A, and the top edges of the outer walls of the lower container part 10B and the doors 12B, are engaged as shown in the sectional side view of the outer wall in FIG. 9 to increase the sealability. Namely, as shown in FIG. 9, the bottom edges of the outer walls and the doors 12A of the upper container part 10A are bent inwardly upward, and the top edges of the outer walls and the doors 12B of the lower container part 10B are bent outwardly downward, such that, in the first state, the two bent portions engage (interlock). Note that a sealing member or the like may be provided along the inside of the lower edges of the outer walls and the doors 12A, and along the outside of the upper edges of the outer walls and the doors 12B, such that the sealability is enhanced by the engagement of these sealing members, or a combination of these configurations may be employed.

According to the container of the first embodiment as described above, the lower container part can easily be housed within the upper container part by way of tilting the posts. Consequently, the volume of the container can easily be reduced when the container is empty, and in turn container transport efficiency is improved.

Figure 10:
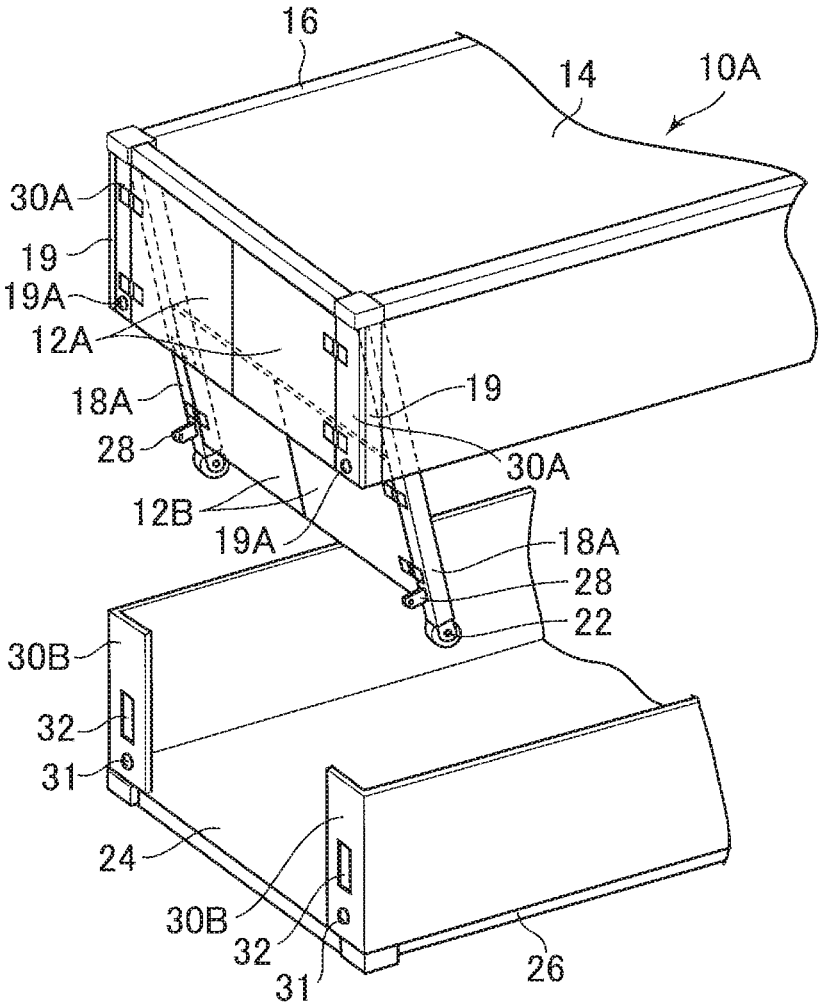
FIG. 10 is a partial enlarged perspective view of a container in a variation of the first embodiment.

FIG. 10 shows a variation of the dry container of the first embodiment. As for the container 10 of the first embodiment, the lower doors 12B were attached to the edges 30B at the two sides of the opening in the lower container part 10B via the hinges or the like. In the variation, the lower doors 12B are attached to the posts 18A via hinges or the like, and the wall of the lower container part 10B at the end opposite to the lower doors 12B is attached to the posts 18B using fasteners, welding or the like. Accordingly, in the variation, when transforming the container from the first state to the second state by pushing down the posts 18A and 18B, an operator can tilt the posts 18A and 18B by merely pushing the lower doors 12B or the wall of the lower container part 10B at the end opposite to the lower doors 12B inward from outside the container 10, and thus work efficiency is improved. Furthermore, in the variation, the auxiliary posts 19 in the first embodiment are omitted, and the outer shell of the corners that include the edges 30A on both sides of the upper container part 10A are used in place of the auxiliary posts 19. Here, the auxiliary locking mechanism is, for example, configured by providing holes 19A and 31 in lower portions of the edges 30A on both sides and in the edges 30B on both sides. In the second state, a fastening device such as a bolt or the like is inserted through the holes 19A and 31 so as to fix the upper container part 10A to the lower container part 10B.

Note that, with the exception of that described above, the configuration of the illustrated upper container part is the same as the upper container part 10A in the first embodiment shown in FIG. 4. The upper doors 12A are attached to the side edges 30A via the hinges or the like and the wall of the upper container 10A at the end opposite to the upper doors 12A is integrated with the two sidewalls of the upper container 10A. A configuration is, however, also possible in which the upper doors 12A are also attached to the posts 18A via the hinges or the like and the wall of the upper container 10A at the end opposite to the upper doors 12A is attached to the posts 18B using fasteners, welding or the like.

Next, the configuration of a dry container in a second embodiment will be described with reference to the sectional side view of a container in FIG. 11 and the enlarged side view in FIG. 12. In the second embodiment, the configuration of the posts in the container 50 differs from that of the posts 18 in the first embodiment. Furthermore, the doors 12A and 12B and the rear walls 13A and 13B are each attached to the posts. However, the rest of the configuration is the same as in the first embodiment. Hereafter, the same reference numerals are used for components that are the same as in the first embodiment, and description thereof is omitted.

Figure 11:
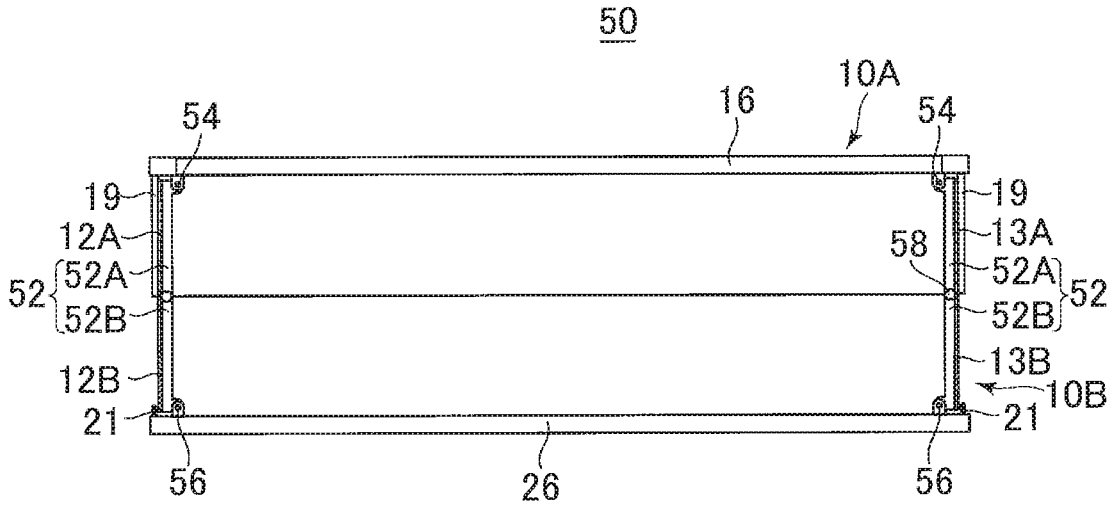
FIG. 11 is a sectional side view of a container in a second embodiment.
Figure 11:
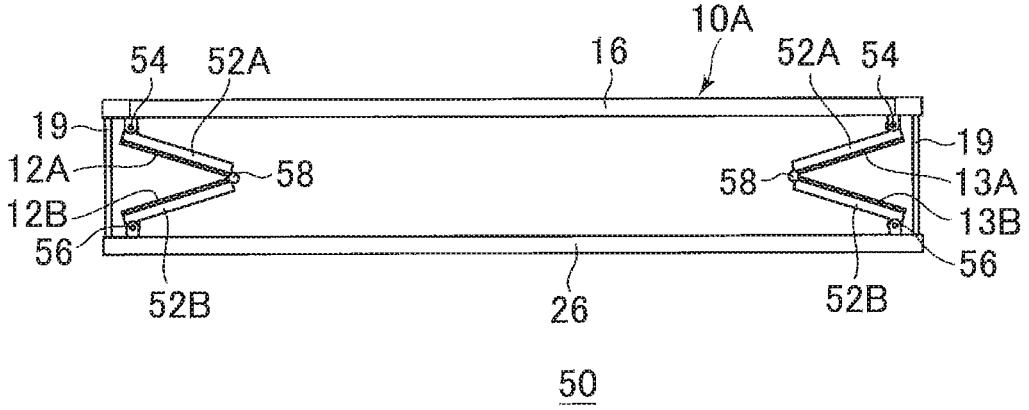
Figure 12:
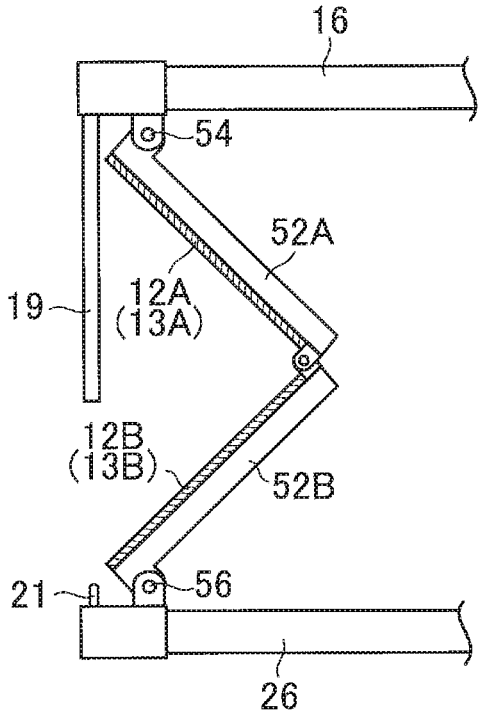
FIG. 12 is an enlarged side view showing the structure of a post in the container in FIG. 10.

FIG. 11 (*a*) shows the container 50 in the first state, and FIG. 11 (*b*) shows the container 50 in the second state. Four posts 52, which are supported at the four corners of the upper container part 10A in the second embodiment, are attached at their top ends to the frame 16 of the upper container part 10A via hinges 54, and the bottom ends of the posts 52 are attached to the frame 26 of the lower container part 10B, via hinges 56. Furthermore, the posts 52 are divided at the approximate lengthwise centers thereof, into an upper post 52A and a lower post 52B, the bottom end of the upper post 52A and the top end of the lower post 52B being connected via a hinge 58. Namely, the posts 52 can be bent inward in the lengthwise direction of the container around the hinges 58 and are maintained in a bent state when the upper container part 10A is in the second state having the second height, as shown in FIG. 11 (*b*). Note that, for example, rotary dampers are provided on the hinges 58. The container 50 is provided with a post locking mechanism that prevents the posts 52 from bending when in the first state, in which the posts 52 are upright.

Figure 13:
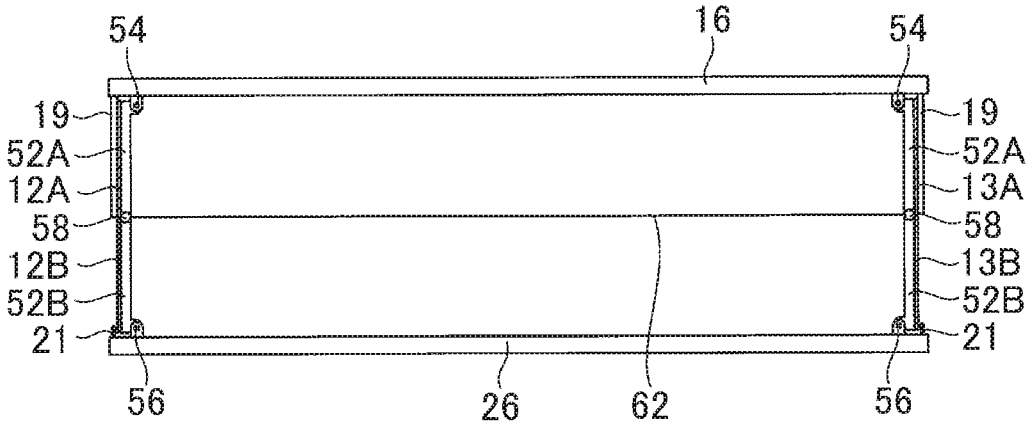
FIG. 13 is a view showing one example of a linking mechanism used in a container in the second embodiment.
Figure 13:
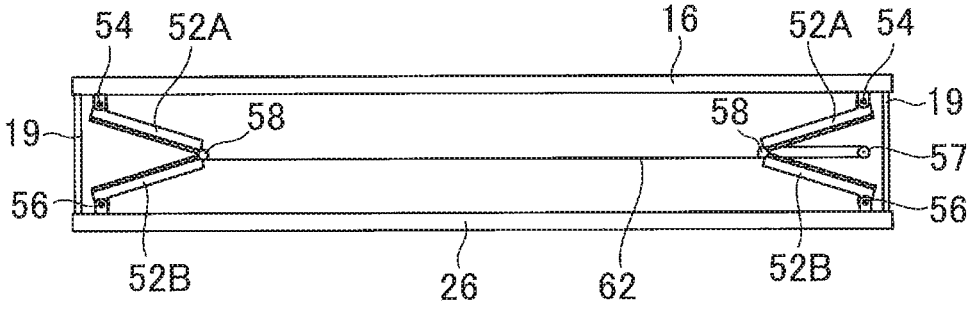

Furthermore, in the second embodiment, a configuration such as shown in FIG. 13 is, for example, employed as the post tilting assist mechanism. Specifically, the hinges (bending parts) 58 on the posts 52 that are arranged on the side closest to the doors 12 and the hinges (bending parts) 58 on the posts 52 that are arranged on the side closest to the rear wall 13 are connected by a pulling instrument such as a wire 62, so that when one of the bending parts is bent inward in the lengthwise direction, the movement pulls the other bending part inward in the lengthwise direction, by way of the wire 62, and thus the two are bent in a linked manner. In this configuration, for example, one end of the wire 62 is attached to one of the hinges 58, and the wire 62 is extended outward in the lengthwise direction of the container, and via a pulley 57 or the like, the wire 62 is guided toward the opposite end in the lengthwise direction of the container along a side wall, and in turn the other end of the wire 62 is attached to the other hinge 58. Note that the pulley 57 or the like is attached to the side wall or the frame or the like of the upper container part 10A or the lower container part 10B or the like. Furthermore, it suffices that the post tilting assist mechanism be configured so as to be able to assist the movement of the posts, and is not limited to configurations in which the posts are pulled, but rather may also be configured so as to push the posts inwards.

An effect similar to that of the first embodiment can also be obtained by the container in the second embodiment as described above.

Next, the configuration of a dry container in a third embodiment will be described with reference to the schematic sectional side view of a container in FIG. 14. The container 60 of the third embodiment has a counterbalancing function provided to the configuration of the container in the first embodiment or the second embodiment. The description of those components that are the same as in the first embodiment or the second embodiment will be omitted.

Figure 14:
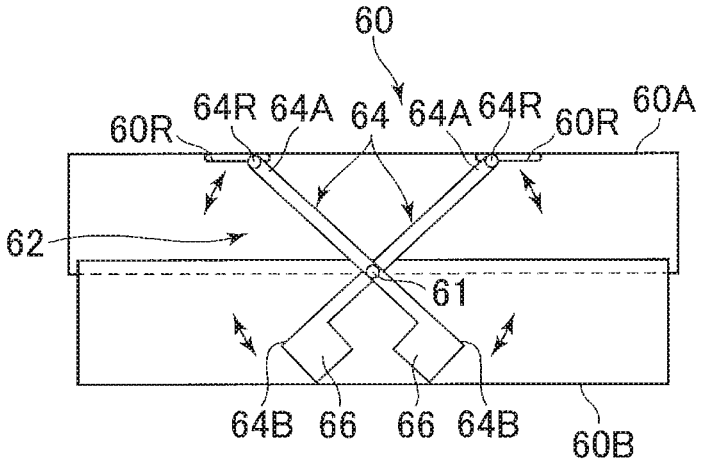
FIG. 14 is a schematic side view of a container in a third embodiment.
Figure 14:
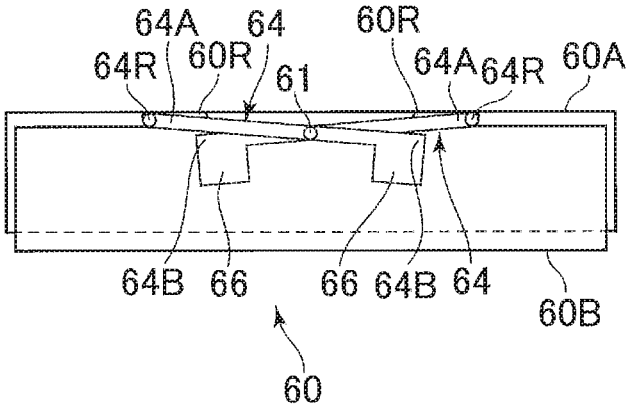

FIG. 14 (*a*) shows a counterbalancing mechanism 63 in a first state, in which a container 60 has a maximum volume, and FIG. 14 (*b*) shows a counter balancing mechanism 63 in a second state, in which the container 60 has a minimum volume. As shown in FIG. 14, the counterbalancing mechanism 63 is configured, for example, using a lever member 64 of which a portion about the center is pivotally supported on the side wall of a lower container part 60B. One end (engagement end) 64A of the lever member 64 is engaged with the roof panel of the upper container part 60A, and a counterweight 66 is attached to the other end (weight end) 64B of the lever member 64. The container 60 exemplified in FIG. 14 is provided with two sets of counterbalancing mechanisms 63, each counterbalancing mechanism 63 being installed on a respective side wall, at the center of the container 60 in the longitudinal direction.

Each of the sets of counterbalancing mechanisms 63 on each of the respective sides comprises a pair of lever members 64 pivotally supported on a single pivot 61, such that, in this embodiment, the container 60 is provided with four lever members 64 in total. The four counterweights 66 provided on the four lever members 64 serve to counterbalance with the upper container part 60A via the counterbalancing mechanisms 63. The weight of the counterweights 66, the number of the lever members 64, the lever ratios and the like are determined in order to balance forces with the weight of the upper container part 60A.

In other words, by way of the counterbalancing mechanism 63, the weight of the upper container part 60A is substantially balanced by the counterweight 66, such that the upper container part 60A can be moved relative to the lower container part 60B by applying only a slight upward force to achieve the first state depicted in FIG. 14 (*a*). In the present embodiment, when the container 60 is in the first state, each set of the counterbalancing mechanisms 63 take on an X shape, in which the engaging ends 64A abut against the roof panel of the upper container part 60A, while the weight ends 64B are located near the floor panel of the lower container part 60B, due to the weight of the counterweights 66. In the first state, the upper container part 60A is supported mainly by the posts 18, 52 or the like (see FIG. 2 and FIG. 11) described in the first and second embodiments.

In the first state shown in FIG. 14 (*a*), when the post locking mechanism is released and a downward force is applied to the upper container part 60A, the posts 18, 52 or the like are rotated around the hinges and thus titled with the roof panel of the upper container part 60A supported by both right and left sets of counterbalancing mechanisms 63, as described in the first and second embodiment, such that the upper container part 60A is slowly lowered toward the lower container part 60B. Thereafter, when the second state depicted in FIG. 14 (*b*) is reached, the lever members 64 are close to the horizontal state, and the upper container part 60A is supported by the auxiliary posts 19 at the four corners, as described in the first and second embodiment (see FIG. 3).

Note that, when the upper container part 60A is ascending and descending, the engaging end 64A of the lever member 64 must move in the longitudinal direction of the container along the side wall as well as pushing against the upper container part 60A. Accordingly, in order for this movement of the engaging end 64A to be performed smoothly, it is preferable to provide a roller 64R at the engaging end 64A and to further provide a rail member 60R, on which the roller 64R runs, along the side wall on the roof panel of the upper container part 60A. Furthermore, a slide guide, a linear bearing or the like may be used instead of the roller 64R and the rail member 60R, such that the engaging end 64A is rotatably attached to the movable member such as the slide guide or a linear bearing.

As described above, according to the third embodiment, in addition to the effects of the first and second embodiments, it is possible to move the upper container part up and down more easily.

Figure 15:
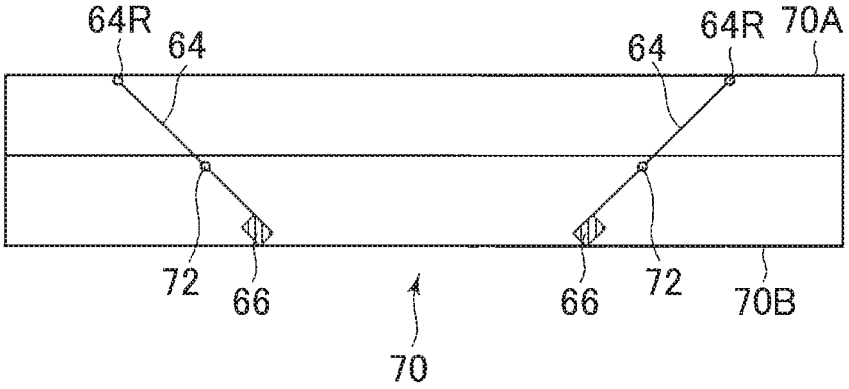
FIG. 15 is a schematic side view of a container in a first variation of the third embodiment.
Figure 16:
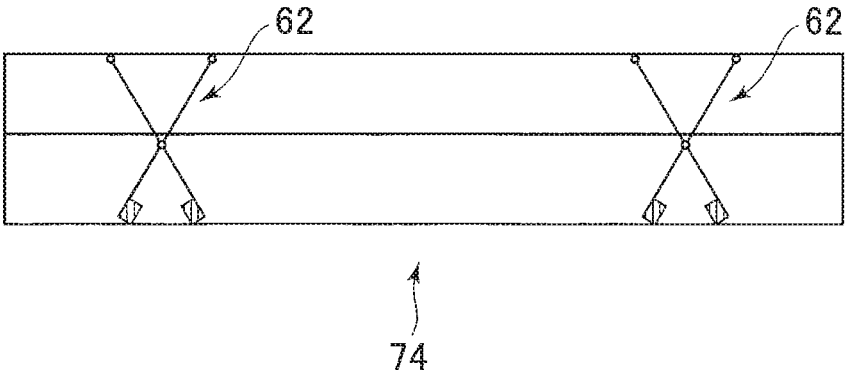
FIG. 16 is a schematic side view of a container in a second variation of the third embodiment.
Figure 17:
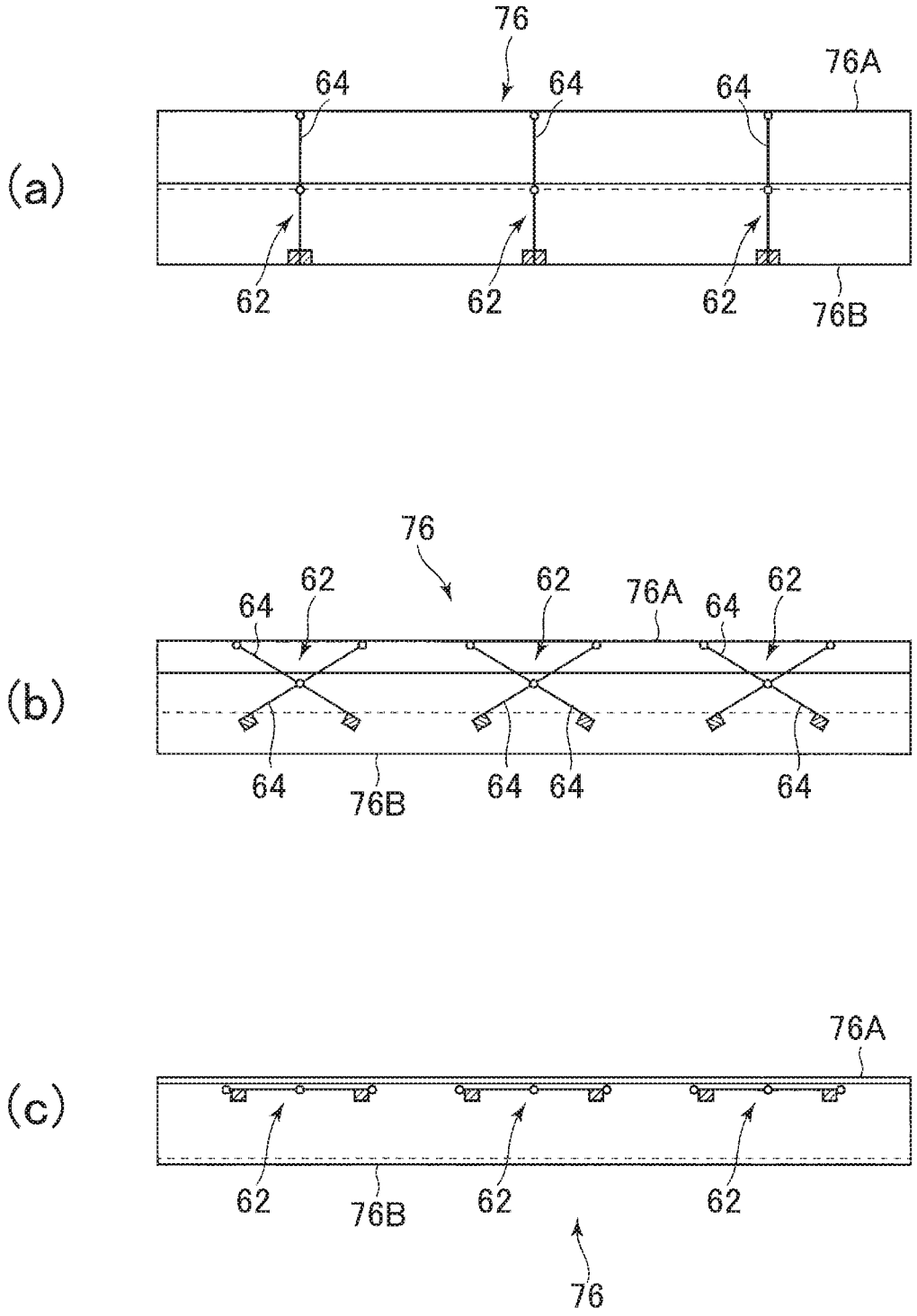
FIG. 17 is a schematic side view of a container in a third variation of the third embodiment.

Next, variations of the third embodiment are illustrated in FIGS. 15 to 17. In the first variation shown in FIG. 15, for example, a counterbalancing mechanism is applied to a container 70 that conforms to a longer standard than the container 60 of FIG. 14. In the first variation, the four lever members 64 in the third embodiment are pivotally supported by separate pivots 72, 72 on the respective side walls. In the illustrated example, the two lever members 64 on each of the respective side walls are supported pivotally about respective pivots 72, 72 at positions on the side closer to the ends of the container 70 in the longitudinal direction of the container (for example, at the positions about one quarter of the length of the container from the ends), in symmetrical postures with respect to each other. Note that the configuration is otherwise the same as in the third embodiment. Consequently, the positions supported by the counterbalancing mechanism are distributed so that it can be applied to longer containers. Note that, in the illustrated example, the engaging end 64A is outwardly inclined, but the engaging end 64A may also be inwardly inclined.

FIG. 16 is a schematic side view of the second variation. The second variation uses two sets of the counterbalancing mechanism 63 of the third embodiment on each of the right and left sides of the container, i.e., four counterbalancing mechanisms 63 in total. Similar to the first variation, each of the counterbalancing mechanisms 63 is arranged at positions on the side closer to the ends of the container 74 in the longitudinal direction of the container (for example, at positions about one fifth of the length of the container from the ends). Effects similar to those in the first variation are also obtained by the second variation.

FIG. 17 is a schematic side view of the third variation. In the third variation, the counterbalancing mechanisms are applied to a considerably longer container 76, such as a 40-foot container, and three sets (total of six) of counterbalancing mechanisms 63 are arranged on both sides (twelve as the number of lever members 64). However, different from the first variation, in the third variation the two lever members 64, 64 in each set stand upright respectively in the first state shown in FIG. 17 (*a*). Namely, the engaging ends 64A, 64A of the pair of lever members 64, 64 in each group are engaged with the roof panel of the upper container part 76A, at approximately the same positions, such that the 12 lever members 64 are engaged with the roof panel of the upper container part 76A in six places.

In the third variation, the two lever members 64, 64 in each set are substantially positioned horizontally in the second state shown in FIG. 17 (*c*). Note that FIG. 17 (*b*) shows an intermediate state between the first state and the second state. As described above, effects similar to those in the first and second variations are also obtained by the third variation. Furthermore, strength against loads from the lateral direction of the container 76 is further improved, since in the first state, a gap between the roof panel of the upper container part 76A and the floor panel of the lower container part 76B is supported by two lever members 64, 64, which are overlaid in the width direction of the container. Note that the configuration of the third variation is otherwise the same as in the first and second variations.

In the present embodiments, auxiliary posts were mounted on the upper container part, but the auxiliary posts may also be mounted on the lower container part. Furthermore, in the first embodiment, rollers were provided on the bottom ends of the posts, but bearings also may be used, so long as they facilitate the movement of the bottom ends. Rails, which engage with the rollers, may also be arranged along the side walls. In the first embodiment, bolts and nuts were used for the post locking mechanisms, but any configuration may also be used so long as it is capable of fastening the posts. For example, the configuration in which a rod member is passed through a side wall and engaged in a post may be applied. Furthermore, in the present embodiments, rotary dampers were used, but linear dampers that damp the linear movement of the post ends may also be used. Note that, in addition to the post tilting assist mechanism, the container may further be provided with a mechanism for raising the posts, in order to transform the container from the second state to the first state.

In the present embodiments, the container was divided vertically into two parts, but it is also possible that the container be divided vertically into three or more parts, in which case the volume of an unloaded container can be further reduced. Furthermore, in the present embodiments, the container was divided vertically into two equal parts, but the vertical division need not be equal. In addition, in the present embodiments, the container was collapsed until the lower container part was substantially entirely housed inside the upper container part, but any ratio of the upper container part and the lower container part, the second height to the first height, may be adopted, such as ⅔ or ⅓. In this case, the sidewalls in the second embodiment may be made, for example, from flexible members including cellulose nanofibers, or may be configured foldable.

The dry containers in the present embodiments were provided with doors at only one end, but the container may also be configured with doors provided at both ends in the lengthwise direction. Furthermore, in the present embodiments, dry containers were described by way of example, but the present invention can be applied to containers of other types, such as refrigerated containers. Note that, by making some or all of the container components in these embodiments, such as the frame, the walls, and the locking mechanisms from cellulose nanofibers or plastic material, the weight can be reduced and the strength can be enhanced. Incidentally, any well-known material that satisfies the design conditions, such as the strength, weight, durability and the like, may be adopted for any components. Furthermore, the configurations described herein for the embodiments and their variations can be combined in various ways, so long as these are structurally compatible.

Note that the positions and shapes of the counterweights shown in this embodiment are illustrated schematically, but the counterweights are not limited to specific positions or shapes as long as they can obtain a certain degree of balance with the weight of the upper container part. Furthermore, in the present embodiment, the counterweight directly attached to the lever member is illustrated. However, a link member, such as a wire and the like may be interposed between the lever member and the counterweight. Furthermore, a counterbalancing mechanism that employs a counter-spring instead of a weight can also be adopted. Moreover, any type of counterbalancing mechanism may be adopted, so long as a certain degree of balance is obtained with respect to the weight of the upper container part. Furthermore, so long as the configuration does not result in disadvantages, it is possible to adopt various combinations of each of the embodiments and their variations set forth in the present embodiments and the examples listed herein.

10, 50, 60, 70, 74, 76 container
10A, 60A, 70A, 74A, 76A upper container part
10B, 60B, 70B, 74B, 76B lower container part
12 door
16, 26 frame
18, 52 post
19 auxiliary post
20, 54, 56, 58 hinge
60R rail member
61 pivot
63 counterbalancing mechanism
64 lever member
64R roller
66 counterweight

The invention claimed is:

1. A container comprising:

a container body having a horizontally elongated rectangular parallelepiped shape, the container body including an upper container part with four container corners and a lower container part with four container corners;

four rotatable posts respectively disposed at positions adjacent said four container corners of the upper container part, each of the rotatable posts including a first end and a second end that is opposite to the first end; and a hinge located at each of said positions, said first end of each respective rotatable post being rotatably connected to a respective hinge, to permit the rotatable posts to rotate with respect to the four container corners of the upper container part, wherein each of the upper container part and the lower container part includes a frame having a plurality of frame corners, the container body is movable between a first position in which the upper container part is at a first height with respect to the lower container part and a second position in which the upper container part is at a second height that is lower than the first height, the first and second heights extending in a direction transverse to a plane of the horizontally elongated rectangular parallelepiped shape of the container body, the rotatable posts being rotated about the hinges inwardly in a lengthwise direction of the container body when the container body is moved from the first position to the second position, each of the second ends of the rotatable posts contacts and moves over a floor panel of the lower container part when the rotatable posts are rotated and the container body is moved between the first and second positions, wherein the second end of each of the rotatable posts includes a roller, one of the container parts includes four auxiliary posts each having first and second ends, said auxiliary posts being rigidly attached to respective frame corners of one of said frames to support the upper container part on the lower container part in the second position, in the first position, each of the first and second ends of the auxiliary posts being out of contact with the frame corners of the other of said frames, wherein when the container body is positioned in the second position, the auxiliary posts abut the frame corners of both of the frames, and each of the auxiliary posts is positioned closer to a respective container corner of one of the container parts than a respective one of the rotatable posts.

2. The container according to claim 1, further comprising an auxiliary post lock, attached to the container body, to fasten the auxiliary posts to the upper container part, in order to maintain the container body in the second position.

3. The container according to claim 1, further comprising a post lock, connected to each of the rotatable posts, that locks movement of the rotatable posts, in order to maintain the container body in the first position.

4. The container according to claim 1, wherein two of the four rotatable posts form a pair in a width direction of the rectangular parallelepiped shape of the container body, and the two rotatable posts are connected to each other such that the two rotatable posts are rotatable together without moving relative to one another.

5. The container according to claim 1, further comprising a biasing spring connected to each of the rotatable posts, and each biasing spring assists movement of a respective rotatable post by exerting a force on the second end of the respective rotatable post when the container body is moved from the first position to the second position.

6. The container according to claim 1, wherein the container body includes a pair of faces that oppose one another in the lengthwise direction of the container body and each of the faces comprises a door or a wall, and the door or the wall is retained by the rotatable posts.

7. The container according to claim 1, wherein the container body includes a pair of side faces that oppose one another in a width direction of the container body that are deformable.

8. The container according to claim 1, further comprising a counterweight, connected to the upper container part, to counterbalance a weight of the upper container part.

9. The container according to claim 1, wherein the auxiliary posts are spaced from the hinges or the rotatable posts.

10. The container according to claim 1, wherein each of the upper container part and the lower container part includes sidewalls, and in the second position, the sidewalls of the lower container part are nested within the sidewalls of the upper container part.

11. The container according to claim 1, wherein the rotatable posts are rotationally attached to the frame of the upper container part.

12. The container according to claim 1, wherein side walls of the upper container part are positioned outside of side walls of the lower container part in the second position.

13. The container according to claim 1, wherein a height of the container body in the second position is approximately one half a height of the container body in the first position.

14. A container comprising:

a container body having a horizontally elongated rectangular parallelepiped shape, the container body including an upper container part with four container corners and a lower container part with four container corners, wherein each of the upper container part and the lower container part has a rectangular shape;

four rotatable posts respectively disposed at positions adjacent said four container corners of the upper container part, each of the rotatable posts including a first end and a second end that is opposite to the first end; and a hinge located at each of said positions, said first end of each respective rotatable post being rotatably connected to a respective hinge, to permit the rotatable posts to rotate with respect to the four container corners of the upper container part, wherein each of the upper container part and the lower container part includes a frame having a plurality of frame corners, the container body is movable between a first position in which the upper container part is at a first height with respect to the lower container part and a second position in which the upper container part is at a second height with respect to the lower container part, the second height being lower than the first height, the first height and the second height extending in a direction transverse to a plane of the horizontally elongated rectangular parallelepiped shape of the container body, the rotatable posts being rotated about the hinges inwardly in a lengthwise direction of the container body when the container body is moved from the first position to the second position, each of the second ends of the rotatable posts being free from connection to the lower container part, and upon rotation of the rotatable posts and movement of the container body between the first position and the second position, each of the second ends moves over a floor panel of the lower container part along a path parallel to a surface of the lower container part, wherein the second end of each of the rotatable posts includes a roller, one of the container parts includes four auxiliary posts each having first and second ends, said auxiliary posts extending in the direction transverse to the plane of the horizontally elongated rectangular parallelepiped shape of the container body and being rigidly attached to respective frame corners of one of said frames to support the upper container part on the lower container part in the second position, in the first position, each of the first and second ends of the auxiliary posts being out of contact with the frame corners of the other of said frames, wherein when the container body is positioned in the second position, the auxiliary posts abut the frame corners of both of the frames, and each of the auxiliary posts is positioned closer to a respective container corner of one of the container parts than a respective one of the rotatable posts.

15. The container according to claim 14, wherein, each of the upper container part and the lower container part includes sidewalls, and in the second position, the sidewalls of the lower container part are nested within the sidewalls of the upper container part.

16. The container according to claim 14, wherein a height of the container body in the second position is approximately one half a height of the container body in the first position.

* * * * *